US006052089A

United States Patent [19]

Eggleston

[11] Patent Number: 6,052,089

[45] Date of Patent: Apr. 18, 2000

[54] HALF-WAVE RETRACTABLE ANTENNA WITH MATCHING HELIX

[75] Inventor: Steve Eggleston, San Diego, Calif.

[73] Assignee: Nokia Mobile Phones Limited, Espoo, Finland

[21] Appl. No.: 09/092,802

[22] Filed: Jun. 5, 1998

Related U.S. Application Data

[60] Provisional application No. 60/068,545, Dec. 23, 1997.

[51] Int. Cl.[7] ..... H01Q 1/24

[52] U.S. Cl. ..... 343/702; 343/895

[58] Field of Search ..... 343/702, 725, 343/749, 750, 895, 900, 901; H01Q 1/24, 1/36

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson | 343/895 |
| 5,343,213 | 8/1994 | Kottke et al. | 343/702 |
| 5,446,469 | 8/1995 | Makino | 343/702 |
| 5,612,704 | 3/1997 | Cole | 343/702 |
| 5,635,943 | 6/1997 | Grunwell | 343/702 |
| 5,717,408 | 2/1998 | Sullivan et al. | 343/702 |
| 5,734,351 | 3/1998 | Ojantakanen et al. | 343/702 |
| 5,861,859 | 1/1999 | Kanayama et al. | 343/895 |

*Primary Examiner*—Don Wong
*Assistant Examiner*—Tho Phan
*Attorney, Agent, or Firm*—Daniel D. Tagliaferri; Brian T. Rivers

[57] ABSTRACT

A retractable whip antenna incorporating a matching base loading helix for use in mobile communications devices is disclosed. The antenna functions without the use of a matching circuit since selection of the radiating elements provides a constant input impedance to the transceiver circuitry. The resulting antenna provides excellent gain over the PCS frequency band, low SAR values, circuit design flexibility and low cost. In a preferred embodiment, the retractable whip is comprised of a radiating element with an electrical length of ½ wavelength and having a first end attached to a conductive spring contact. The base loading helix comprises a radiating helical element with an electrical length of ¼ wavelength and having a first end connected to a mobile transceiver circuit and a second end comprising a conductive capturing coil. The radiating whip element is constrained within the coil of the helical element and is freely moveable to an extended or a retracted position. When the whip element is in the retracted position, the whip element is disconnected from the radiating circuit. When the whip element is in an extended position, an electrical connection is formed via contact between the conductive spring contact and the conductive capturing coil, wherein the helical element effectively base loads the whip element so that the two radiating elements have a combined electrical length of ¾ wavelength.

7 Claims, 3 Drawing Sheets

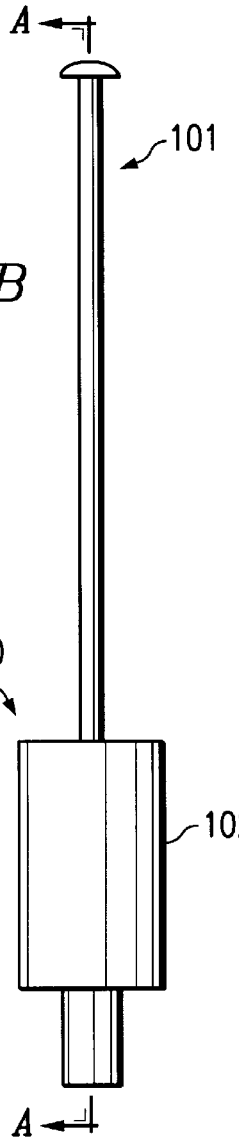
FIG. 1B
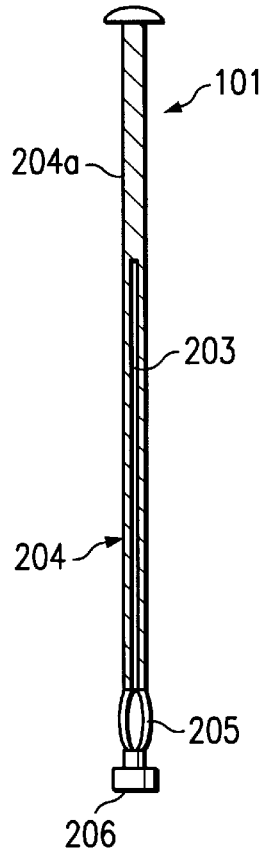
FIG. 2A
FIG. 1A
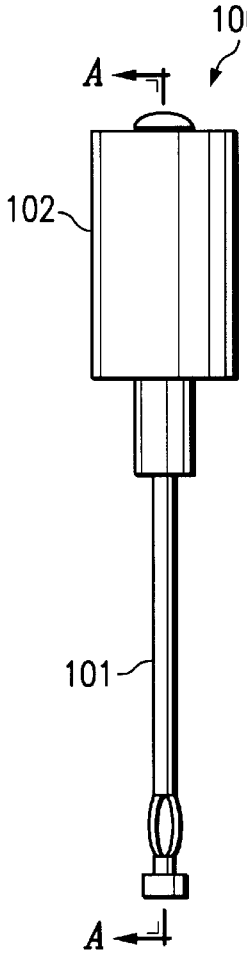
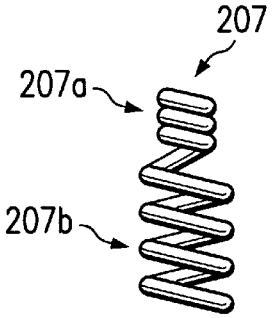
FIG. 2B
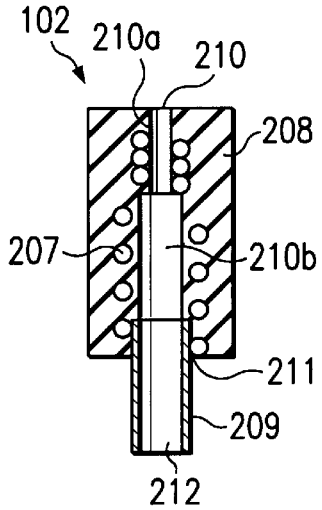
FIG. 2C FIG. 3A
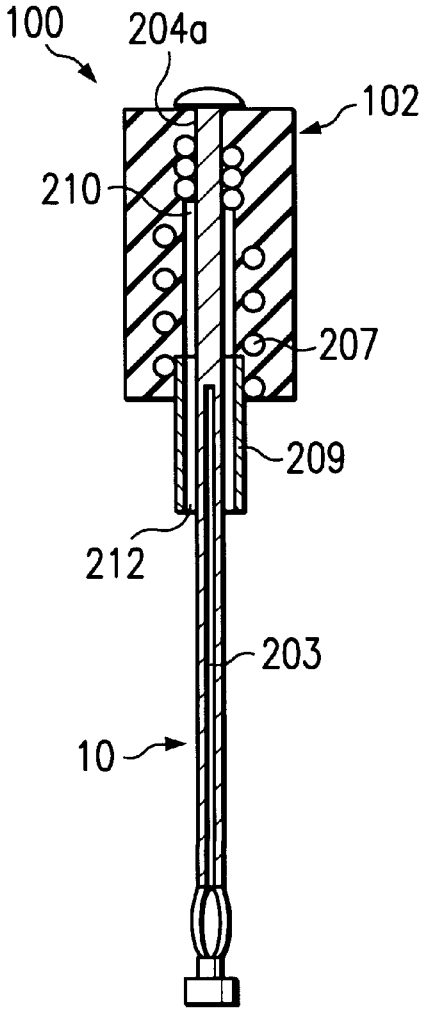
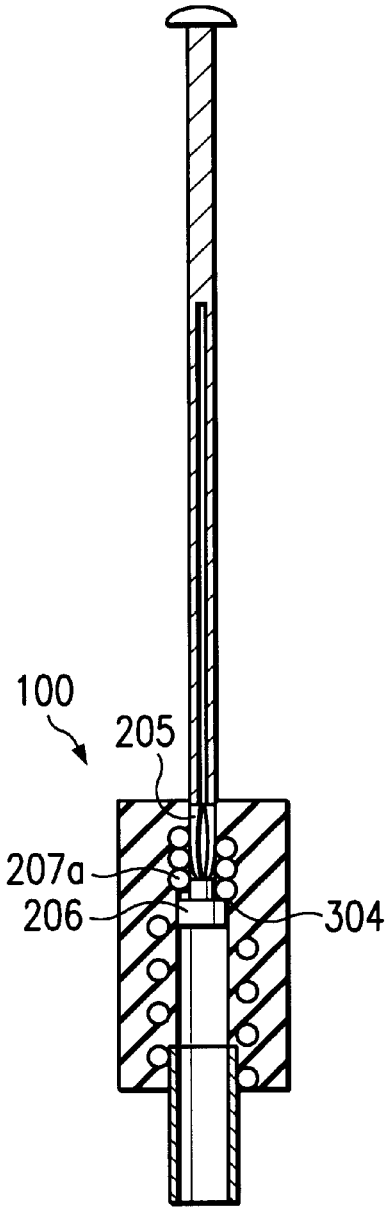
FIG. 3B

HALF-WAVE RETRACTABLE ANTENNA WITH MATCHING HELIX

CLAIM OF PRIORITY FROM A COPENDING PROVISIONAL PATENT APPLICATION

Priority is herewith claimed under 35 U.S.C. § 119(e) from copending Provisional Patent Application Ser. No. 60/068,545, filed Dec. 23, 1997, entitled "Base Loaded Whip Antenna," by Steve Eggleston. The disclosure of this Provisional Patent Application is incorporated by reference herein in its entirety.

FIELD OF INVENTION

The present invention relates generally to antennas and, more particularly, to retractable whip antennas for use in mobile communications devices.

BACKGROUND OF INVENTION

As electronics and communications technology has advanced, mobile communication devices have become increasingly more sophisticated. In the early stages, mobile communications devices provided voice only communications utilizing analog transmission techniques as developed under the Advanced Mobile Phone System (AMPS) EIA-553 standard. Under this standard, analog voice signals are modulated onto carrier signals set at predetermined frequencies in the range of 800 to 1000 MHz. To transmit and receive at these frequencies, early mobile communications devices utilized simple monopole antennas such as fixed whips or physically shorter helicals. Over time, multi-segmented retractable whips were implemented to provide users with more compact designs and durability. Although analog systems provide relatively good quality voice transmission, the power requirements are relatively high, system capacity is low, there is little voice security and the overall system is susceptible to interference from other transmitting devices. Recently, digital transmission systems utilizing spread spectrum transmission techniques such as Code Division Multiple Access (CDMA) have become more widely used. These systems are being developed under the EIA/TIA/IS-95 standard. In these systems, analog voice signals are converted to the digital domain, orthogonally encoded and then spread by a pseudo-random spreading signal so as to occupy a 1.25 MHz frequency band. From this spread signal, in-phase and quadrature phase signals are generated which are then combined and modulated onto a carrier in the frequency range of 800 to 1000 MHz. Antennas developed for these newer systems include non-segmented retractable whips, helical stubs and combination designs utilizing both whips and helicals. Generally these antennas are designed to operate with an electrical length of ½ wavelength or less. By converting the analog voice signals into the digital domain and then executing the encoding and spreading functions, the resulting digital system can offer superior performance. Some of the benefits of these digital systems are higher capacity, reduced power requirements, voice security and increased resistance to interference.

As a natural result of improvements in the field of mobile communications, and the need for added competition, the Personal Communications Systems (PCS) is now evolving. The Personal Communication Systems (PCS), as defined under the ANSI-J-STD-008 standard, utilizes Code Division Multiple Access (CDMA) techniques and is allocated the frequency range of 1800 to 2000 MHz. One benefit of PCS is that they offer many of the same features as systems developed under the IS-95 standard. Another benefit of these systems is that competition between service providers is enhanced since more of the available frequency spectrum is allocated to spread spectrum communication systems. Although improvements in call processing and data handling developed for IS-95 systems may be transported to PCS, the same is not true for antenna designs. Since PCS operate at twice the frequency of IS-95 systems, new antenna designs are required to provide adequate signal gain, radiation patterns and Specific Absorption Ratio (SAR) values to achieve optimum PCS performance.

There currently exists a need in the mobile communications industry for an antenna capable of operating in the frequency range allocated for PCS. Antennas in this category must be capable of transmitting and receiving radio frequency signals in the band of 1800 to 2000 MHz. Due to the fact that PCS implementations around the world utilize slightly different frequency assignments, a single antenna device capable of operating over a range of frequencies would provide the optimum solution. This could best be achieved with an antenna having an electrical length of ¾ wavelength. An antenna of this length would have excellent gain over the desired frequency range while providing a low SAR value, thereby providing the required functionality in combination with user safety. In addition, the antenna device should have a predetermined input impedance for coupling to transceiver electronics. To allow for low cost and design flexibility, the input impedance should remain constant under all operating conditions of the antenna, thus eliminating the need for a special impedance matching circuit. Such an antenna should have a convenient mounting mechanism making it adaptable to various mechanical housings and be durable enough to withstand the type of rough handling normally associated with mobile communication devices.

OBJECTS OF THE INVENTION

It is therefore an object of this invention to provide an improved antenna for a mobile communications device that overcomes the foregoing and other problems.

Another object and advantage of this invention is to provide an antenna for a mobile communications device that may be configured to operate over the range of frequencies allocated for use in Personal Communication Systems (PCS).

It is a further object and advantage of this invention to provide an antenna for a mobile communications device having a predetermined fixed input impedance to allow the antenna to be coupled to a transceiver circuit.

It is a further object and advantage of this invention to provide an antenna for a mobile communications device which can interface to a transceiver circuit without the need of an additional impedance matching circuit.

It is a further object and advantage of this invention to provide an antenna for a mobile communications device which has excellent gain at frequencies used in PCS while maintaining a low SAR value.

BRIEF SUMMARY OF INVENTION

The present invention provides an antenna device comprising a retractable whip radiating element with a matching helical radiating element for use within a mobile communications device. The antenna device is especially suited to operate over the frequency band of 1800–2000 MHz, thus making it ideal for use within Personal Communication Systems (PCS). The antenna device incorporates a helical radiating element having a single detachable connection to a moveable whip radiating element allowing the antenna to operate with the whip element in an extended or retracted position. The overall design of the antenna is simple and it may be inexpensively manufactured.

In an embodiment of the invention, a helical radiating element with an electrical length of approximately ¼ wavelength is used in the antenna device. The helical element has a first end connected to a transceiver circuit of a mobile communications device and provides to the transceiver circuit a predetermined input impedance of approximately 50 ohms. The second end of the helical element comprises a conductive coil contact which can be used to selectively connect to a radiating whip element. When not connected to the whip element, only the helical element is used by the mobile for transmission and reception of data signals.

The whip element used in the antenna device has an electrical length of ½ wavelength. The whip is surrounded by an electrical insulator and has a radial spring contact located at its base end. The whip element is captured within the coils of the helical radiating element and can be freely move to a retracted or extended position relative to the helical element. When in its retracted position, the whip element is disconnected from the helical element so that transmission or reception of data is accomplished through use of the helical element only. The retracted position of the whip element is such that no capacitive coupling occurs between the whip element and the helical element. With the whip element in the extended position, the radial spring contact of the whip element is captured by the conductive coil contact of the helical element. This connection allows the whip element and the helical element to be electrically connected in a series configuration, wherein the helical element inductively base loads the whip element, resulting in the combined elements having a total electrical length of ¾ wavelength. Since the whip element has an electrical length of ½ wavelength, connection or disconnection of the whip from the helical element does not change the predetermined input impedance of 50 ohms set by the helical element. By providing a constant input impedance to the transceiver electronics independent of the position of the whip element, the need for a separate impedance matching circuit is eliminated.

BRIEF DESCRIPTION OF DRAWINGS

The above set forth and other features of the invention are made more apparent in the ensuing Detailed Description of the Invention when read in conjunction with the attached drawings, in which like reference numerals refer to like parts and in which:

FIG. 1A and FIG. 1B depict the antenna of the present invention shown in retracted and extended positions, respectively; the two figures also define cross-sectional view 'A';

FIG. 2A depicts cross-sectional view 'A' of the whip antenna assembly of FIG. 1A;

FIG. 2B depicts a helical radiating element used in the antenna device of FIG. 1A;

FIG. 2C depicts cross-sectional view 'A' of the helical antenna assembly of FIG. 1A;

FIG. 3A and FIG. 3B depict cross-sectional views of the antenna as defined by view 'A' wherein the antenna is shown in retracted and extended positions, respectively.

DETAILED DESCRIPTION OF A PREFERRED EMBODIMENT

Figure 4A:
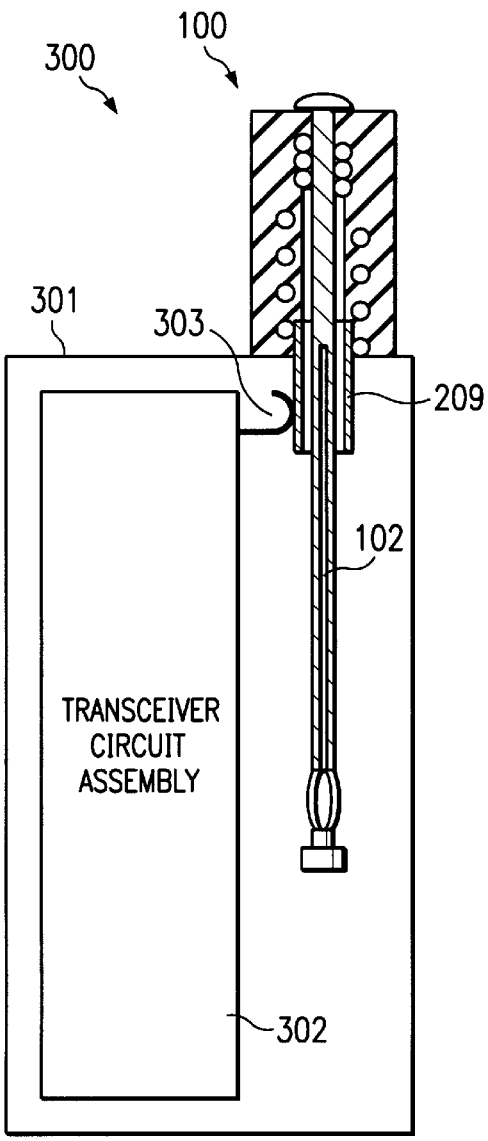
FIG. 4A and FIG. 4B depict cross-sectional views of the antenna as defined by view 'A' wherein the antenna is mounted within the housing of a mobile communications device and shown in retracted and extended positions, respectively.

Referring to FIG. 1A and FIG. 1B, therein is depicted an embodiment of the antenna constructed according to the teachings of the invention. In the figures, antenna 100 comprises a whip antenna assembly 101 and a helical coil assembly 102. FIG. 1A depicts antenna 100 in a retracted position and FIG. 1B depicts antenna 100 in an extended position. Antenna 100 has a cross-sectional view as defined by view 'A'.

Referring now to FIG. 2A, whip antenna assembly 101 is shown in cross-section as defined by view 'A'. Whip antenna assembly 101 comprises whip element 203, whip insulator 204, radial spring contact 205 and stopper 206. Whip element 203 is a conductive radiating element having an electrical length of ½ wavelength. Radial spring contact 205 is disposed on the lower end portion of whip element 203, so that these two components are physically connected and conductively contacted with each other. Radial spring contact 205 has flexible conductive surfaces which form an electrical path to whip element 203. A stopper 206, having a predetermined external diameter, is disposed on a lower portion of the radial spring contact 205. Whip insulator 204, which is comprised of a non-conducting material, completely covers whip element 203 and extends beyond the upper end of whip element 203 to a top portion 204*a*. Further, whip insulator 204 has a fixed exterior diameter along its entire length which is smaller than the exterior diameter of stopper 206.

Referring to FIG. 2B, therein is an isolated view of helical coil element 207. Helical coil element 207 is comprised of a conductive radiator further comprising a top helical portion 207*a* and a lower helical portion 207*b*. Lower helical portion 207*b* has an electrical length of approximately ¼ wavelength. This wavelength value results in the helical element having an input impedance of approximately 50 ohms. By increasing the wavelength value to ⅜ wavelength, a corresponding increase in the input impedance can be achieved. Top helical portion 207*a* has a coil with an interior diameter slightly larger than the exterior diameter of whip insulator 204. Lower helical portion 207*b* has a coil with an interior diameter slightly larger than the exterior diameter of stopper 206. The two coil portions are concentrically located along the same center line with top helical portion 207*a* having a smaller interior diameter than lower helical portion 207*b*.

Referring to FIG. 2C, helical coil assembly 102 is shown in cross-section as defined by view 'A'. Helical coil assembly 102 comprises helical coil element 207, helical insulator 208 and holder conductor 209. Helical coil element 207 is covered by helical insulator 208, which is comprised of a non-conducting material extending completely around top helical portion 207*a* and lower helical portion 207*b*. Further, helical insulator 208 has an insulator opening 210 throughout its length which is along the center line and concentric to helical coil element 207. Insulator opening 210 has a top portion 210*a*, having a diameter approximately equal to the interior diameter of helical top portion 207*a*. Insulator opening 210 has a lower portion 210*b*, having a diameter approximately equal to the external diameter of stopper 206. Holder conductor 209 has a conductive outer surface and is disposed on a lower end portion of helical insulator 208. Further, holder conductor 209 being cylindrical in nature is firmly fixed within at least a lower end portion of helical coil element 207, so that holder conductor 209 and lower helical portion 207*b* are in physical contact and form an electrical connection shown at contact point 211. Contact point 211 has an electrical connecting means not depicted in FIG. 2C, such as a crimp or solder connection. Further, holder conductor 209 has a holder opening 212 throughout its length which correspondingly aligns with insulator opening 210*b*. Both insulator opening 210*b* and holder opening 212 have a diameter slightly larger than the exterior diameter of stopper 206, so that it is possible for stopper 206 to pass through both holder opening 212 and insulator opening 210*b*.

Referring now to FIGS. 3A and 3B, antenna 100 is shown in cross-section as defined by view 'A'. FIG. 3A depicts antenna 100 when operating as an assembled unit in a retracted position. Antenna assembly 101 is accommodated concentrically within helical assembly 102, so that antenna assembly 101 is contained within holder conductor opening 212 and helical insulator opening 210. Antenna assembly 101 is moveable with respect to helical antenna assembly 102 and positioned so that antenna insulator top portion 204*a* is adjacent to helical coil element 207. In this position there is no portion of whip element 203 that overlaps with helical coil element 207. This prevents capacitive coupling from occurring between helical coil 207 and whip element 203. In this retracted position, there is no direct or capacitive electrical connection between the whip and helical antenna elements.

Referring now to FIG. 3B, therein depicts a cross-sectional view of antenna 100 when operating as an assembled unit in an extended position. Whip antenna assembly 101 can be freely moved to a position where stopper 206 is in contact with top helical portion 207*a* as demonstrated at point 304. Further, radial spring contact 205 is physically constrained within top helical portion 207*a*, so that an electrical contact is made between top helical portion 207*a* and radial spring contact 205. In this extended position, whip antenna assemble 101 and helical antenna assembly 102 are physically contacted and electrically connected in a series connection, forming a radiating assembly having a combined electrical length of ¾ wavelength.

Figure 4B:
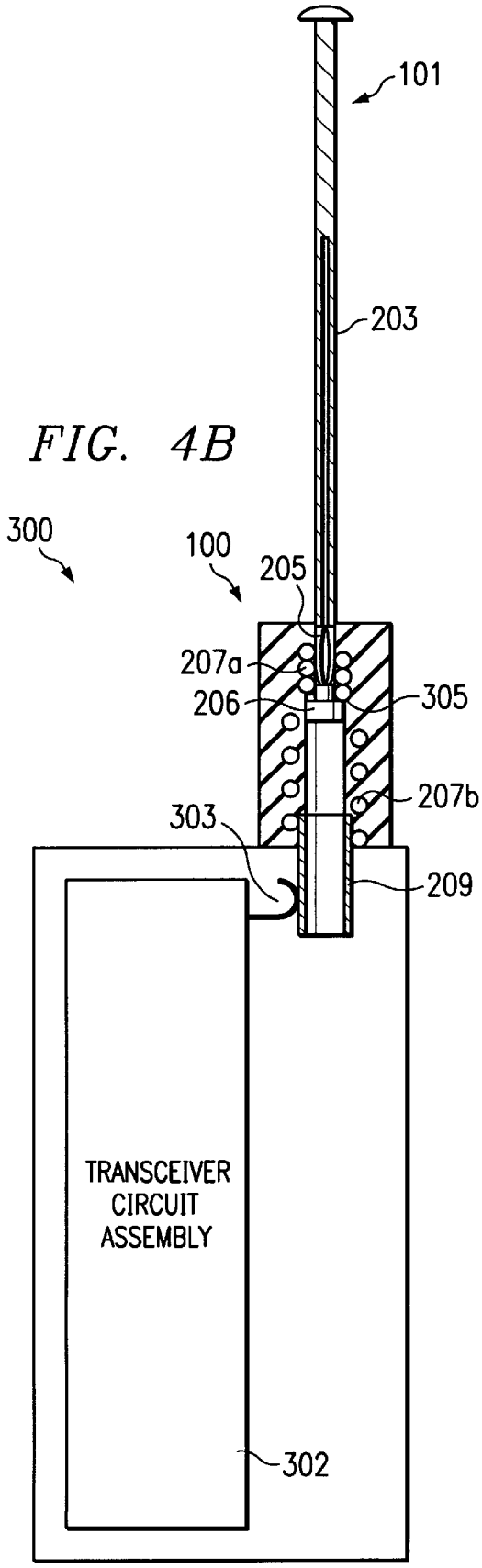

Referring now to FIGS. 4A and 4B, antenna 100 is shown in cross-section as defined by view 'A' and mounted within the structure of a mobile communications device.

Referring to FIG. 4A, therein depicts antenna 100 mounted in a mobile telephone 300 and placed in a retracted position. Mobile telephone 300 comprises a housing 301, transceiver circuit assembly 302, conductive spring connector 303 and antenna assembly 100. Mobile telephone housing 301 has an opening located on a top portion which can accommodate and secure holder conductor 209 with a detachable attachment means not depicted in the figures, such as screw threads. Through this detachable attachment means, antenna 100 may be detached and replaced with a physically similar antenna having different performance or functional characteristics.

Transceiver circuit assembly 302 is physically and electrically connected to conductive spring connector 303. When antenna assembly 100 is mounted and secured in housing 301, conductive spring connector 303 is in physical and electrical contact with the conductive outer surface of holder conductor 209. With antenna 100 in the retracted position as depicted in FIG. 4A, conductive spring connector 303 and holder conductor 209 form a conductive path that connects transceiver assembly 302 to helical coil element 207. Because in the retracted position there is no electrical connection between helical coil element 207 and whip antenna assembly 101, radio frequency transmissions and receptions are accomplished utilizing helical coil element 207 as the only radiating element.

Referring now to FIG. 4B, therein depicts a cross-sectional view of antenna 100 when operating in a mobile telephone 300 and placed in an extended position. In this position, whip antenna assembly 101 is moved to its fully extended position so that contact is achieved between stopper 206 and the coil of top helical portion 207*a*. When in this position, radial spring contact 205 is in electrical contact and physically constrained by the coil of the top helical portion 207*a*. Further, conductive spring connector 303 and holder conductor 209 form a conductive path that connects transceiver assembly 302 to helical coil element 207, which is further connected to whip radiating element 203. This arrangement allows radio frequency transmissions and receptions to be conducted using both helical coil element 207 and whip radiating element 203. These two antenna elements are combined to form a series connection so that helical coil element 207 effectively base loads whip radiating element 203 with the combined elements having an electrical length of ¾ wavelength.

The above-described antenna would be suitable for operation in the PCS frequency range. At ¾ wavelength, the input impedance for coupling to the transceiver circuit would be close to 50 ohms. Increasing the electrical length of the helical element would correspondingly increase the input impedance. By varying the inductive load dimensions and construction, it is possible to change the antenna input impedance and gain pattern.

In the present invention the base loading helical coil serves three purposes. First, it provides a fixed input impedance for coupling the antenna to the transceiver electronics. Connection or disconnection of the ½ wavelength whip element with the helical coil does not affect the value of the fixed impedance. Second, it shortens the length of the current that opposes the current of the ½ wavelength whip antenna section. This serves to reduce the SAR value and provide the desired gain pattern. Third, the helical coil serves as an antenna when the whip element is in the retracted position. The result is a convenient low-cost antenna which provides excellent performance at frequencies allocated to PCS.

In a first alternate embodiment, the helical radiating element may be replaced by a different radiating element, such as a meaderline element or another whip element. By adjusting the electrical length of this replacement element, the input impedance to the transceiver circuit can be set as done by the helical element in the preferred embodiment. It is understood that by replacing the helical element a different mechanical connection between the replacement element and the whip element may be required.

In a second alternate embodiment, the whip element may be replaced by a different radiating element, such as a meaderline element or another helical element. By setting the electrical length of this replacement element to ½ wavelength, the resulting impedance of the antenna will remain the same.

In a third alternate embodiment, both elements as described in the preferred embodiment may be replaced by radiating elements including meaderline, helicals and whip elements.

In a fourth alternate embodiment, the connection between the helical radiating element and the whip radiating element may be modified to include a range of connection types, including solder connections, pin and socket or other types of pressure-contact connectors.

In a fifth alternate embodiment, both radiating elements may be replaced by a single element having an electrical length of ¾ wavelength.

In a sixth alternate embodiment, the whip element may be mounted outside the helical element so that the two elements are physically separated. In this case, a different connection means is required to form a connection between the whip and the helical when the whip is in the extended position.

Although described in the context of particular embodiments, it will be realized that a number of modifications to these teachings may occur to one skilled in the art. Thus, while the invention has been particularly shown and described with respect to specific embodiments thereof, it will be understood by those skilled in the art that changes in form and shape may be made therein without departing from the scope and spirit of the invention.

What is claimed is:

1. An antenna for use with a radio circuit in a communications device, said antenna comprising:

a first radiating element, having a first end and a second end, said first end of said first radiating element comprising a coil of a first selected internal diameter and said second end of said first radiating element comprising a coil of a second selected internal diameter, said first selected internal diameter larger than said second selected internal diameter, and wherein said first radiating element exhibits a selected input impedance at said first end for coupling to the radio circuit;

a second radiating element, having a first end, said first end of said second radiating element comprising a radial spring contact and a stopper, said radial spring contact having a flexible conductive surface terminating in said stopper, said second radiating element detachably connectable to said first radiating element, wherein said radial siring contact is removably insertable into said coil of said second end of said first radiating element and said stopper contacts said coil of said second end of said first radiating element, said radial spring contact and said coil of said second end of said first radiating element forming an electrical connection between said first radiating element and said second radiating element, when the first radiating element and said second radiating element are connected, said selected input impedance of said first radiating element remaining substantially unchanged when said first radiating element is connected to said second radiating element.

2. The antenna according to claim 1, wherein said first radiating element comprises a helical radiating element.

3. The antenna according to claim 2, wherein said helical radiating element has an electrical length substantially equal to ¼ wavelength.

4. The antenna according to claim 1, wherein said second radiating element comprises a whip radiating element.

5. The antenna according to claim 4, wherein said whip radiating element has an electrical length substantially equal to ½ wavelength.

6. An antenna for receiving radio signals, said antenna comprising:

a helical radiating element having an electrical length substantially equal to ¼ wavelength and further comprising a first end and a second end, said first end of said helical radiating element comprising a coil of a first selected internal diameter and said second end of said helical radiating element comprising a coil of a second selected internal diameter, said first selected internal diameter larger than said second selected internal diameter, and wherein said helical radiating element exhibits a selected input impedance at said first end;

a whip radiating element having an electrical length substantially equal to ½ wavelength and further comprising a first end, said first end of said whip radiating element comprising a radial spring contact and a stopper, said radial spring contact having flexible conductive surfaces terminating in said stopper, said stopper having an external diameter larger than said second selected internal diameter, wherein said whip radiating element is accommodated concentrically within said helical radiating element and movable through said helical radiating element from an extended position to a retracted position, said radial spring contact removably inserted into said coil of said second end of said helical radiating element and said stopper contacting said coil of said second end of said helical radiating element when said whip radiating element is moved to said extended position, wherein said helical radiating element and said whip radiating element are electrically connectable in series and exhibit a total electrical length substantially equal to ¾ wavelength when said whip radiating element in said extended position, and, said selected input impedance remaining substantially the same when said whip radiating element is placed in said extended and said retracted positions.

7. An antenna according claim 6, wherein said first end of said helical radiating element further comprises a conductive sleeve having an external diameter slightly less than said first selected internal diameter, so that at least a portion of said conductive sleeve can be accommodated within said first end of said helical radiating element, said conductive sleeve and said first end of said helical radiating element being physically and electrically connected.

* * * * *